United States Patent [19]

Tice

[11] 4,166,936

[45] Sep. 4, 1979

[54] VISCOSITY-COMPENSATING FLOW SWITCH

[75] Inventor: Charles Tice, Plantsville, Conn.

[73] Assignee: DeLaval Turbine Inc., Princeton, N.J.

[21] Appl. No.: 874,260

[22] Filed: Feb. 1, 1978

[51] Int. Cl.[2] ..... H01H 35/38

[52] U.S. Cl. ..... 200/82 E; 340/611; 138/44; 73/211

[58] Field of Search ..... 138/44; 73/248, 249, 73/211, 239, 242; 340/606, 611; 335/205; 200/81.9 M, 82 E

[56] References Cited

U.S. PATENT DOCUMENTS

| | | | |
|---|---|---|---|
| 2,703,494 | 3/1955 | Carney | 73/211 |
| 2,927,462 | 3/1960 | Li | 73/211 |
| 2,984,105 | 5/1961 | Nagel | 73/211 |
| 3,421,124 | 1/1969 | Kidd | 200/81.9 M |
| 3,446,986 | 5/1969 | Cox | 200/82 E |
| 3,551,620 | 12/1970 | Hoover | 200/81.9 M |
| 3,632,923 | 1/1972 | Paine | 200/81.9 M |

*Primary Examiner*—Gerald P. Tolin

*Attorney, Agent, or Firm*—Hopgood, Calimafde, Kalil, Blaustein & Lieberman

[57] ABSTRACT

The invention contemplates an improved magnetically operative flow switch wherein the viscosity sensitivity of a flow-responsive movable metering member is materially reduced, as compared with past constructions. The improvement results from so devising a flow-metering passage through the movable member that such flow is taken only from the center and not from the wall of the inlet-flow passage in which the metering member is movable.

9 Claims, 6 Drawing Figures

VISCOSITY-COMPENSATING FLOW SWITCH

This invention relates to magnetically operated flow switches, and specifically to the variety in which a magnet-equipped piston is displaced by a pressure differential occasioned by fluid flow, to an extent that at a predetermined set-point displacement the magnet actuates magnetic-switch contacts, as provided by a hermetically sealed SPDT reed switch positioned alongside the path of movement of the piston.

Past constructions of the character indicated exhibit great sensitivity to changes in viscosity, accounting in certain cases for a 5 to 10-fold change in flow rate to produce switch operation, depending upon the temperature of a viscous liquid for which flow is to be monitored.

It is, accordingly, an object of the invention to provide an improved flow-switch construction, having materially reduced fluctuation in performance as a function of changes in viscosity of the fluid that is being monitored by the switch.

Another object is to achieve the above object with minimum structural departure from existing constructions.

A further object is to achieve the above objects with a structure which inherently lends itself to selective design for a particular operating set point from within a relatively wide range of possible set points.

A specific object is to provide a viscosity-compensated flow switch which can operate within 20 percent of its design set point in spite of such temperature changes as might develop change in viscosity of a given liquid from 40 to 1550 SSU.

Other objects and various further features of novelty and invention will be pointed out or will occur to those skilled in the art from a reading of the following specification, in conjunction with the accompanying drawings. In said drawings, which show, for illustrative purposes only, a preferred form of the invention:

Figure 1:
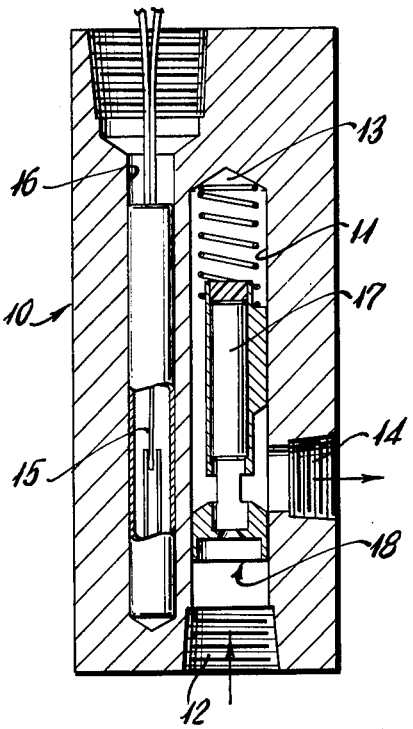
FIG. 1 is a vertical sectional view through a flow switch of the invention.

Referring to FIG. 1, the invention is shown in application to a flow switch comprising a housing or body 10 of non-magnetic material and having an elongate cylindrical bore 11, extending between an inlet-port end 12 and a closed interior end 13. An outlet port 14 communicates with bore 11 at a location spaced from the ends 12–13. A hermetically sealed magnetic-reed switch 15 is positioned and sealed within another bore 16 in body 10, alongside the bore 11, for coaction with a permanent-magnet element 17 carried by a piston 18 of the invention. Piston 18 has guided running clearance with the bore 11 and is normally urged by coil-spring means 19 to a down or no-flow limiting position, of proximity to the inlet-port means 12.

Figure 2:
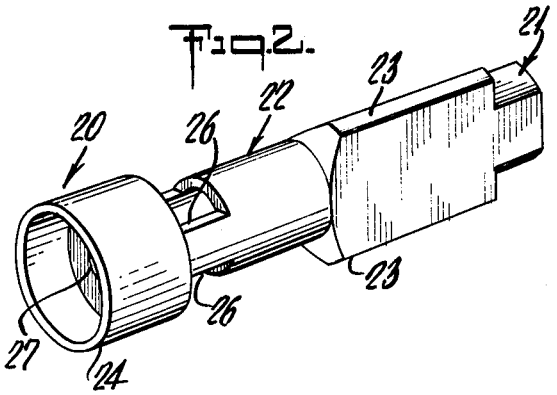
FIG. 2 is an enlarged perspective view of the movable piston element of the switch of FIG. 1.
Figure 3:
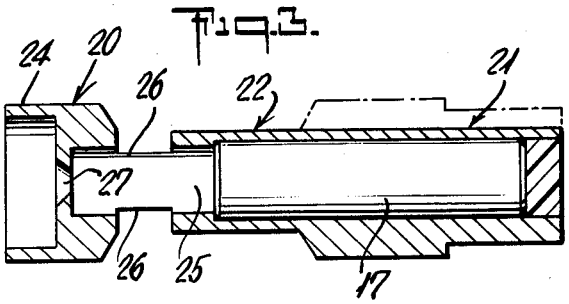
FIG. 3 is a longitudinal sectional view of the piston element of FIG. 1.

In FIGS. 2 and 3, the piston 18 is seen to comprise a head portion 20, a tail portion 21, and a reduced central-body portion 22 interconnecting the head and tail portions 21–22. The tail portion 21 is fluted, to define plural angularly spaced longitudinal ribs or feet 23, having guided running clearance with that part of bore 11 which is between outlet port 14 and the closed end 13. The sectional area of the spaces between ribs 23 is such as to assure free liquid circulation as piston 18 is displaced toward the closed end 13, i.e., against the action of spring 19.

In accordance with the invention, a metering passage for liquid flow between inlet and outlet ports 12–14 is established within head portion 20, providing a passage inlet at the center of head 20, i.e., expressly not at or near the wall of bore 11. To this end, head portion 20 is shown to be generally cup-shaped, with its open end facing the inlet port 12. The skirt 24 of head portion 24 is relatively thin and cylindrical; it has close running clearance with bore 11 and is a means of stabilized piloting of the head end of the piston, thereby assuring that the central flow-metering opening will (a) remain centrally positioned and (b) be the only means of liquid flow between ports 12–14. As shown, a bore 25 in the reduced central portion 22 has side-ported communication at 26 with the circumferential space between bore 11 and the reduced central portion 22, and this space is vented at outlet port 14. Bore 25 extends to the back side of the closed end of head portion 20, and has communication with inlet port 12, via the above-mentioned central passage which specifically includes a restrictive orifice 27. The effective area of orifice 27 will depend upon flow rate to be monitored, i.e., the set point at which switch contacts at 15 are to be operated, due to piston (and, therefore, magnet 17) displacement into a switch-operating position which is indicative of the selected flow rate. Preferably, the passage which includes orifice 27 is convergent, as shown, and is characterized by a sharp-edged downstream definition of the restriction. Preferably also, the effective area of orifice 27 is small compared to that of the inlet and outlet ports 12–14, and is small compared to the effective passage section at bore 25 and its vent ports 26, thus assuring that essentially only pressure differentials attributable to flow at orifice 27 will be determinative of piston displacement.

Figure 4:
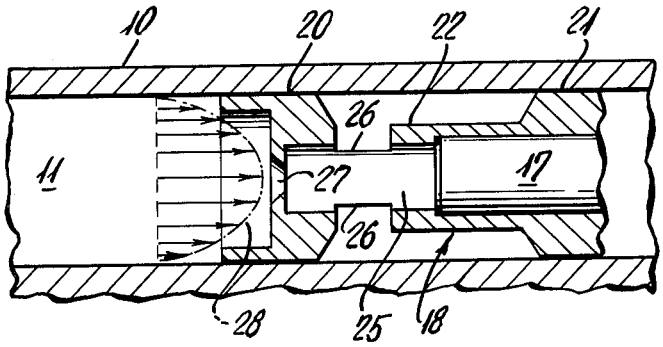
FIGS. 4 and 5 are simplified fragmentary views to demonstrate flow considerations and relationships for the piston element of FIG. 1.
Figure 5:
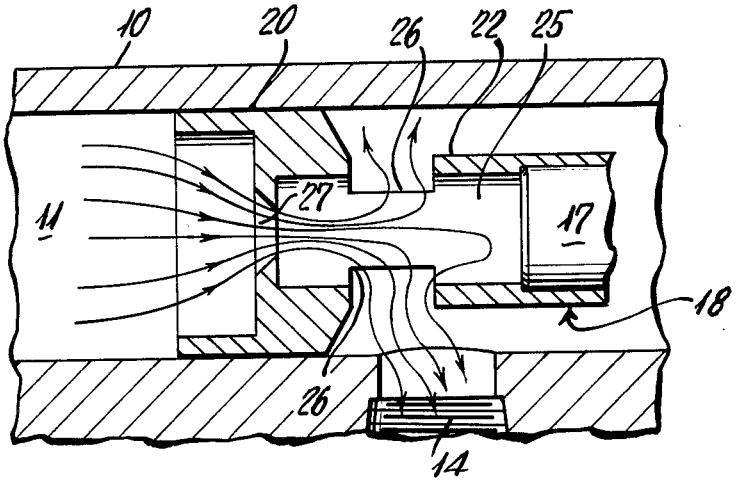

While viscous flow in a restricted passage is not a totally understood phenomenon, it is believed that a discussion in connection with FIGS. 4 and 5 will facilitate understanding. In FIG. 4, the pertinent parts of piston 18 are shown, in the context of a simplified bore 11, and flow of a viscous liquid is symbolized by a plurality of spaced vector arrows having a generally parabolic profile 28 across the section of bore 11. Such a profile 28 emphasizes that whatever the viscosity, liquid motion or movability is greatest at the center, reducing to a virtual standstill at the wall of bore 11. The central placement or orifice 27 takes advantage of the most movable or flowable locale of the bore section, and flow arrows in FIG. 5 emphasize the relatively smooth and free-flow conditions established by central location of the restrictive orifice 27, namely flow from orifice 27 into the relatively large chamber of bore 25, thence venting with no effective restriction, via side ports 26, to the cylindrical annulus or minifold between reduced portion 22 and bore 11, to the outlet port 14.

Figure 6:
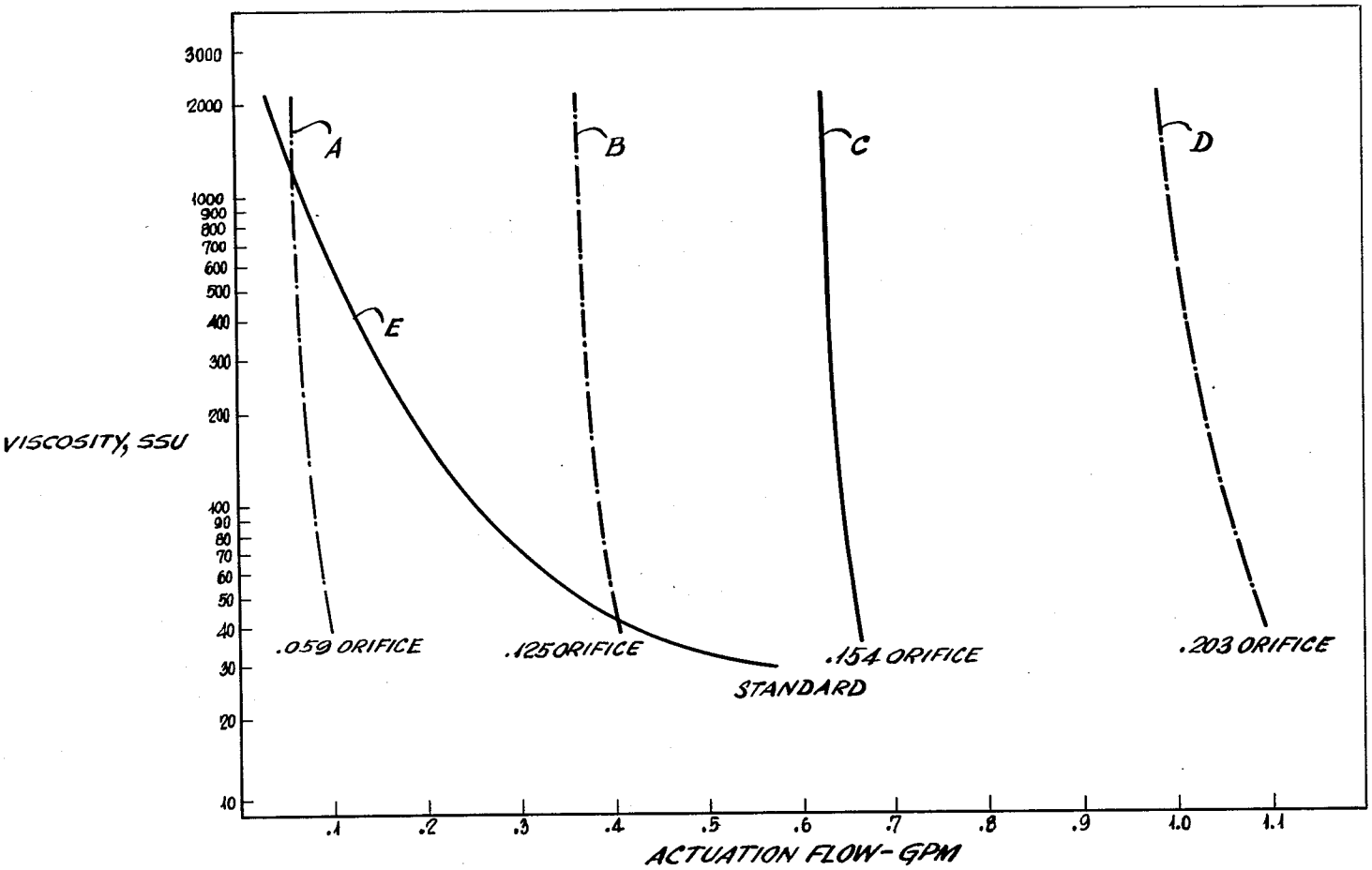
FIG. 6 is a graphical display to demonstrate performance of several differently characterized flow-switch piston elements of the invention, as compared with performance of a conventional flow-switch piston element.

FIG. 6 demonstrates the relative freedom from viscosity limitations, in flow-switch operation with a piston of the invention, for the case of a succession of four progressively larger restrictive orifices, commencing with a 0.059-in diameter orifice (Curve A) and progressing to a 0.125-in diameter orifice (Curve B), to a 0.154-in diameter orifice (Curve C), and to a 0.203-in diameter orifice (Curve D), all curves being plots of viscosity for data taken in the range 40 to 1550 SSU, as a function of flow rate, and using MIL-H-5606 oil as the test fluid. For comparison, a prior-art switch unit, identical except for use of a standard prior piston was tested over the same viscosity range, the same being displayed at Curve E. As can be seen from FIG. 6, the construction of the invention provides less than 20 percent fluctuation in set-point flow rate, over the full 40 to 1550 SSU viscosity range indicated; whereas, with the prior construction (Curve E), the change in set point is more than 500 percent over the indicated viscosity range.

It will be seen that I have provided an improved flow switch meeting all stated objects and offering enormously enhanced reliability and accuracy to those who must operate with fluids which exhibit great differences in viscosity under varying ambient-temperature conditions. For example, in a typical hydraulic system which has been "shut down" for a period of time, the fluid temperature at "start-up" may be 50 degrees F., but after a period of "running time," the fluid temperature may reach 125 degrees F., resulting in a much lower fluid viscosity; the piston of the invention can be designed to actaute its associated magnetic switch 15 at essentially the same flow rate at the 50-degree fluid temperature as at the 125-degree fluid temperature. Essentially, the sharp-edged orifice, located at the center of the flow section, is insensitive to the viscosity of the fluid.

While the invention has been described in detail for the preferred form shown, it will be understood that modifications may be made without departure from the claimed scope of the invention.

What is claimed is:

1. A magnetically operated flow switch comprising a body having an elongate cylindrical bore closed at one end and establishing an inlet port at the other end, said body having an outlet port communicating with the bore at a location spaced from both ends of the bore, magnetic-reed switch contacts carried by said body alongside the bore and at a location predetermined for a set point of monitored flow between said inlet and outlet ports, a piston including a metering-head portion having a cylindrical periphery in circumferentially continuous close running clearance with the bore and deriving movable support in the bore between said ports and a permanent-magnet tail portion deriving movable support in the bore between the closed end and said outlet port, said piston including a reduced central body portion between said head and tail portions, said piston having a central axial passage through said head portion and including a restrictive orifice establishing controlled fluid communication between said ports, and said tail portion including plural angularly spaced ribs at the region of bore support, the sectional area between ribs substantially exceeding the effective orifice area, whereby fluid flow via said passage and therefore between inlet and outlet ports is limited to the fluid at the central region of the section of inlet flow, thereby minimizing changes in switch response as a function of fluid viscosity.

2. In a magnetically operated flow switch wherein a piston having a metering head and equipped with a permanent magnet is guided for longitudinal displacement in a cylindrical guide bore of a switch body, and wherein magnetically operated switch contacts are carried by the switch body for operation at a predetermined longitudinal location of magnet proximity, and wherein the bore has longitudinally spaced inlet and outlet ports between which the metering head is positionable, the improvement in which said head has a peripheral contour having circumferentially continuous close running clearance with the guide-bore contour over a predetermined range of longitudinal displacement of said piston in the bore, said piston having a reduced exterior with respecto to dimensions of said head at a location between said metering head and magnet and in constant fluid communication with the outlet port, said head having a central axial passage including a restrictive orifice which receives and passes therethrough substantially all of the fluid flow between the inlet and outlet ports, whereby fluid flow via said passage and therefore between inlet and outlet ports is limited to the fluid at the central region of the section of inlet flow, thereby minimizing changes in switch response as a function of fluid viscosity.

3. A magnetically operated flow switch comprising a body having an elongate cylindrical bore closed at one end and establishing an inlet port at the other end, said body having an outlet port communicating with the bore at a location spaced from both ends of the bore, magnetic-reed switch contacts carried by said body alongside the bore and at a location predetermined for a set point of monitored flow between said inlet and outlet ports, a piston including a metering-head portion deriving movable support from and in circumferentially continuous close running clearance with the bore over a predetermined range of longitudinal displacement of said head portion between said ports and a permanent-magnet tail portion deriving movable support in the bore between the closed end and said outlet port, said piston including a reduced central body portion between said head and tail portions, and said piston having a central axial passage through said head portion and including a restrictive orifice which receives and passes therethrough substantially all of the fluid flow between said ports, whereby fluid flow via said passage and therefore between inlet and outlet ports is limited to the fluid at the central region of the section of inlet flow, thereby minimizing changes in switch response as a function of fluid viscosity.

4. The flow switch of claim 3, in which said head portion has a cylindrical periphery in circumferentially continuous close running clearance with the bore.

5. The flow switch of claim 3, or claim 1, and including a coil-spring element coacting between said tail portion and the closed end of the bore and compressionally loading said piston to a normal no-flow position of greatest proximity to said inlet port.

6. The flow switch of claim 3, in which said reduced central body portion has a central axial bore communicating with said passage and of greater sectional area than the effective orifice area, and in which said central body portion has a side-porting passage establishing fluid communication between the central axial bore and said outlet port.

7. The flow switch of claim 6, in which said side-porting passage is one of two at diametrically opposed areas of said central body portion.

8. The flow switch of claim 4, in which said head portion is generally cup-shaped with a cylindrical skirt having close running clearance with the bore, the open end of said skirt facing the inlet port, and the central axial passage being in the closed end of said cup-shaped head portion.

9. The flow switch of claim 8, in which said restrictive orifice is defined by a sharp-edge convergent taper in the closed end of said cup-shaped head portion.

* * * * *